US005960780A

United States Patent [19]

Harris

[11] Patent Number: 5,960,780

[45] Date of Patent: Oct. 5, 1999

[54] LIGHTWEIGHT STONE CUTTING APPARATUS

[76] Inventor: K. Michael Harris, 7343 El Camino Real #319, Atascadero, Calif. 93422

[21] Appl. No.: 08/813,693

[22] Filed: Mar. 7, 1997

[51] Int. Cl.[6] ..... B28D 1/04

[52] U.S. Cl. ..... 125/13.01; 125/14

[58] Field of Search ..... 125/13.01, 14, 125/12; 451/545, 541

[56] References Cited

U.S. PATENT DOCUMENTS

| | | | |
|---|---|---|---|
| 2,736,311 | 2/1956 | Coates | 125/14 |
| 3,323,507 | 6/1967 | Schuman | 125/14 |
| 3,722,497 | 3/1973 | Hiestand et al. | 125/14 |
| 3,763,845 | 10/1973 | Hiestand et al. | 125/14 |
| 5,328,161 | 7/1994 | Stuck | 269/909 |

*Primary Examiner*—Eileen P. Morgan
*Attorney, Agent, or Firm*—Daniel C. McKown

[57] ABSTRACT

An apparatus and a method for producing accurate straight cuts in a slab of stone, concrete, or the like. A carriage conveys the cutter along two parallel rails that lie directly upon the upper surface of the slab to be cut. In a preferred embodiment of the invention, neither rail is connected to anything else, and a sheet of resilient material is bonded to the underside of each rail. A calibration instrument is disclosed, which is used to facilitate spacing the rails specific distances on either side of the desired cut line. Because the rails can be moved one at a time in the preferred embodiment, the apparatus is highly portable. In an alternative embodiment in which portability is not an important consideration, the rails may be permanently connected by rigid lateral members.

4 Claims, 4 Drawing Sheets

FIG.5
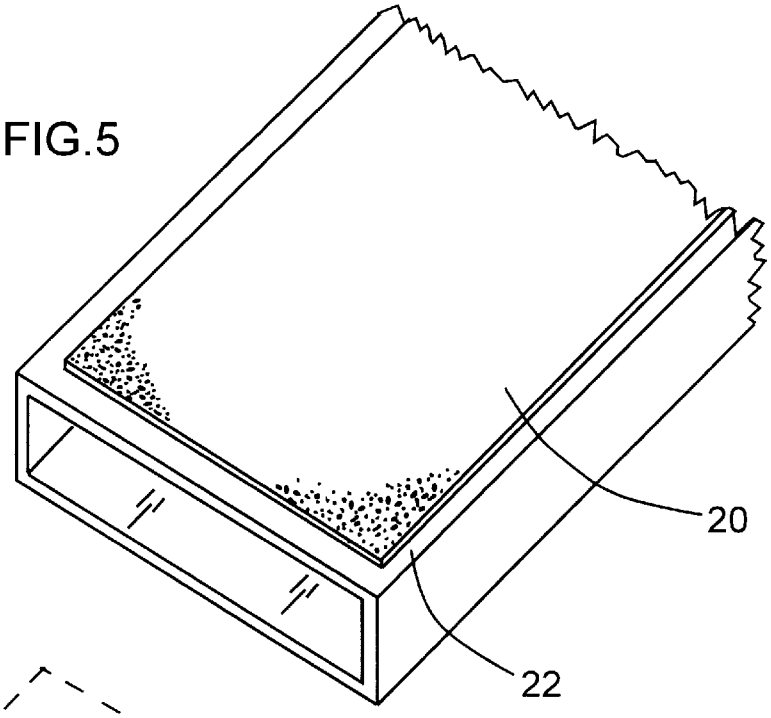
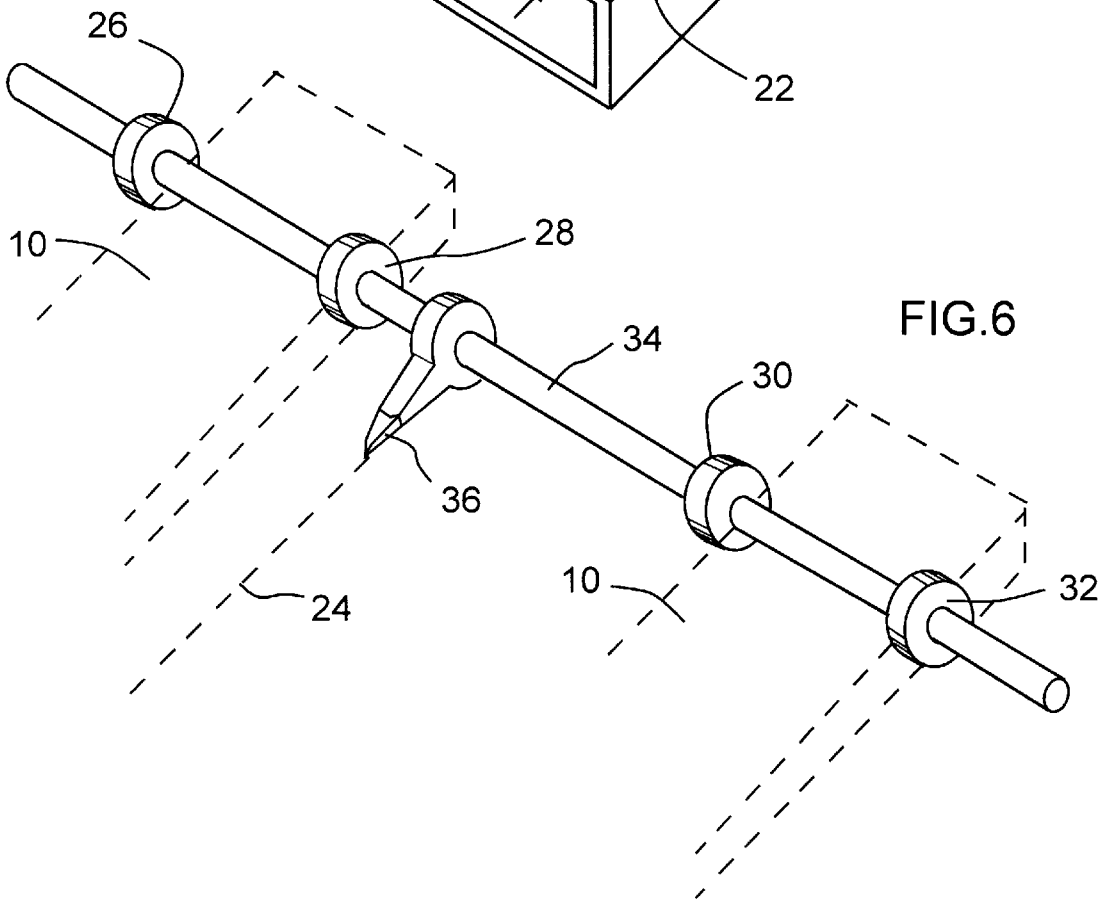
FIG.6

LIGHTWEIGHT STONE CUTTING APPARATUS

BACKGROUND OF THE INVENTION

1. Field of the Invention

The present invention is apparatus and a method for cutting or sawing a slab of stone or similar material.

2. The Prior Art

A substantial number of patents are concerned with apparatus for cutting slabs of stone, concrete or the like. These include: British Patent No. 1,058,958 of Wholton et al.; U.S. Pat. No. 2,736,311 of Coates; U.S. Pat. No. 5,442,984 of Tate; U.S. Pat. No. 3,207,016 of Huff; U.S. Pat. No. 4,998,775 of Hollifield; U.S. Pat. No. 5,398,458 of Henriksen et al.; and U.S. Pat. No. 2,619,081 of Johnson.

In these patents, the slab of stone remains fixed and the cutter is mounted on a carriage that is moved along a set of parallel rails that are spaced above the slab. In some instances, such as Wholton et al., Huff, and Tate, the rails are mounted on a table-like structure, while in other instances the rails are part of a large and heavy installation.

In order to provide an open space to accommodate the slab and to permit free passage of the cutting tool, it is common practice to support the rails at their ends only. The desirability of being able to make lengthy cuts is well recognized. As a result, the rails in the prior art devices were lengthy compared to the cross sectional size of the rails.

The difficulty of making these extended rails rigid can be readily appreciated. Pure sagging of the rails in a vertical direction was tolerable since it affected mainly the depth of the cut. However, several other factors were at work.

First, the carriage that was moved along the rails was not balanced, with the result that the carriage applied more weight to one of the rails than to the other. The more heavily loaded rail sagged more, thereby causing the top of the cutting blade to tilt laterally toward the more heavily loaded side.

A second source of inaccuracy was caused by the manner in which the carriage was pushed along the rails. Ordinarily, the carriage was pushed by the user, and no special precautions were taken to assure that the applied force, which often included a downward component, was equally distributed between the two rails. Depending on the location of the handgrip relative to the rails, it was not unusual for one of the rails to be loaded more heavily than the other, again resulting in a tilting of the cutter blade.

The typical reaction of prior art designers to these causes of inaccuracy was to make the rails and their supporting structures less flexible. In most instances this resulted in a much heavier structure, which therefore was much less portable. It was generally thought that lightweight apparatus could not produce accurate cuts, and if accurate cuts were to be achieved, a large, heavy, and therefore non-portable machine was required.

Thus, conventional design philosophy, starting with the assumption that the rails must be spaced above the workpiece, led to the conclusion that accurate cutting could only be achieved with large, heavy, fixed installations and that lightweight portable equipment could not produce cuts of satisfactory accuracy.

The present inventor has devised a totally different design approach that runs counter to the conventional design philosophy and that permits remarkable accuracy to be achieved with lightweight portable equipment.

SUMMARY OF THE INVENTION

As an experienced stone fabricator, the present inventor was aware of the fact that a very high percentage of the stone cutting that is done is performed on slabs of stone that have already been prefinished so that their surfaces are relatively flat. These slabs are typically used for kitchen and bathroom counters, and the required cutting is for the purpose of trimming the slabs to a desired size.

The gist of the present invention is as follows. Instead of using rails suspended and spaced above the workpiece as in the prior art, the present inventor took the unprecedented step of laying the rails directly on top of the workpiece, in contact with it.

By this single bold stroke, problems resulting from deformation of the rails were completely overcome. It was no longer necessary to use rails heavy enough to support a moving carriage that typically weighed several hundred pounds, because in the new approach, the workpiece itself, a slab of granite, undergirds the rails and prevents them from sagging. This permits the rails to be made much lighter, which permits, in one embodiment, tracks twelve feet long that weigh only 24.5 pounds each.

Portability is extremely important, because it enables the cutting to be done onsite. This eliminates the need to transport the slabs to a cutting facility along with templates made at the job site, and then returning the cut slabs to the job site.

In carrying out his radical design approach, the present inventor uses rails that are hollow tubes of rectangular cross section in a preferred embodiment. As a practical matter, he found it advantageous to apply a long strip of a soft rubber to the underside of the rails, which bears against the slab. This rubber strip prevents movement of the rails with respect to the workpiece once the rails have been manually positioned on it.

Because the lateral location of the cutting blade is not at the center of the carriage, the rails will not be positioned symmetrically with respect to the marked cut line. To facilitate proper positioning of the unconnected rails with respect to the marked cut line (and to assure that the rails are parallel), the inventor has devised a calibration tool that greatly reduces set-up time.

In an alternative embodiment that is more attractive when shorter rails can be used or when portability is not a factor, the rails are connected to each other but continue to be laid directly onto the slab in accordance with the present invention.

The novel features which are believed to be characteristic of the invention, both as to structure and method of use, together with further objects and advantages thereof, will be better understood from the following description considered in connection with the accompanying drawings in which several embodiments of the invention are illustrated by way of example. It is to be expressly understood, however, that the drawings are for the purpose of illustration and description only and are not intended as a definition of the limits of the invention.

BRIEF DESCRIPTION OF THE DRAWINGS

FIG. 5 is a bottom side end perspective view showing part of a rail of the type used in a preferred embodiment of the present invention;

FIG. 6 is a perspective view of a calibration device used with a preferred embodiment of the present invention to position the rails with respect to a desired line to be cut;

DETAILED DESCRIPTION OF THE PREFERRED EMBODIMENT

Figure 1:
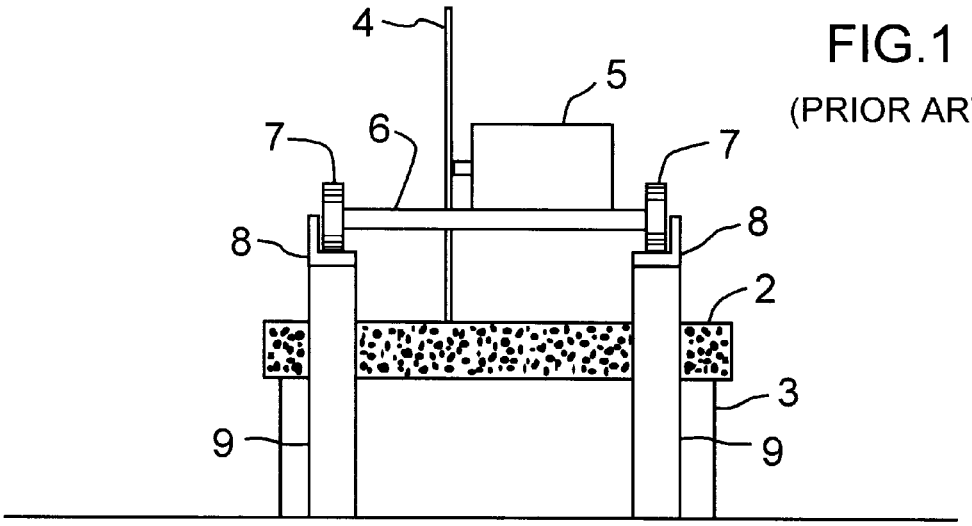
FIG.1 (PRIOR ART)
FIG. 1 is an end elevational view of a typical prior art apparatus for cutting slabs of stone.
Figure 2:
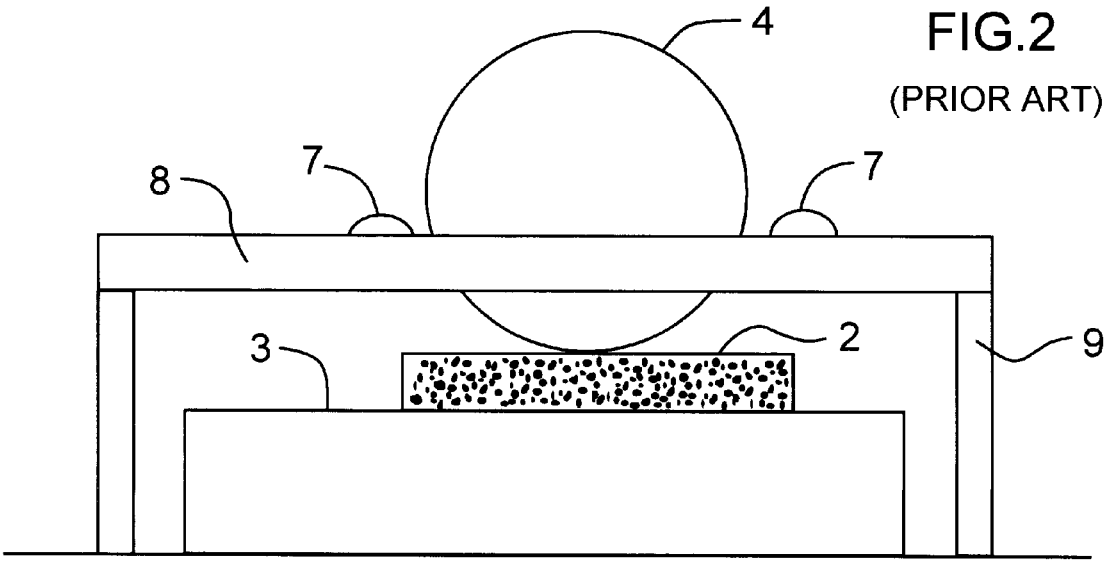
FIG.2 (PRIOR ART)
FIG. 2 is a side elevational view of the prior art apparatus of FIG. 1.

FIGS. 1 and 2 exemplify the prior art. The slab 2 of stone, concrete, or the like, was laid on a sturdy table or stand 3. The cutting blade 4 and its motor 5 were mounted on a carriage 6 having four wheels, of which the wheel 7 is typical. The wheels 7 run on rails 8 which are supported above the slab 2 by the supports 9.

Initially, the slab is moved laterally until the cutting blade 4 is immediately above the desired cut line. Thereafter, the cutting blade is lowered into contact with the slab, and the carriage 6 is pushed along the rails 8 to develop the cut.

The slab 2 could weigh several hundred pounds, and because of its weight the frictional force between the slab and the table 3 was so great that the slab had little tendency to move with respect to the table 3.

As seen in FIG. 2, the rails 8 tend to be elongated and are usually supported at their ends by the supports 9. The carriage 6, loaded with the cutting blade 4 and the motor 5 might typically weigh hundreds of pounds, and unless the rails are strong and heavy, elastic deformation can be a problem. To make matters worse, the amount of deformation depends on the location of the carriage along the rails.

It seemed that the only practical solution to these problems which plagued the prior art apparatus was to make the rails ever more rigid. Unfortunately, rigidity translates into greater weight, which means portability is decreased.

There are many situations, such as sawing ice or fire wood, where a high degree of accuracy is not required. However, the present invention is concerned with cutting slabs of stone which may be used on counter tops and other highly viable areas in a home. For such applications, departures from a straight lines of more than approximately 2 millimeters are considered unacceptable, and ideally errors should not exceed 1.0 millimeter in a length of 10 feet.

Figure 3:
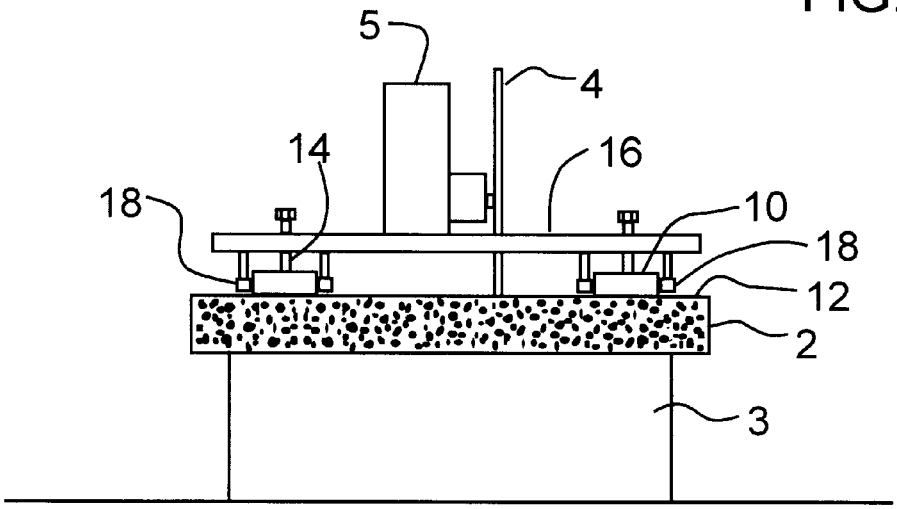
FIG. 3 is an end elevational view of a preferred embodiment of the apparatus of the present invention for cutting slabs of stone.
Figure 4:
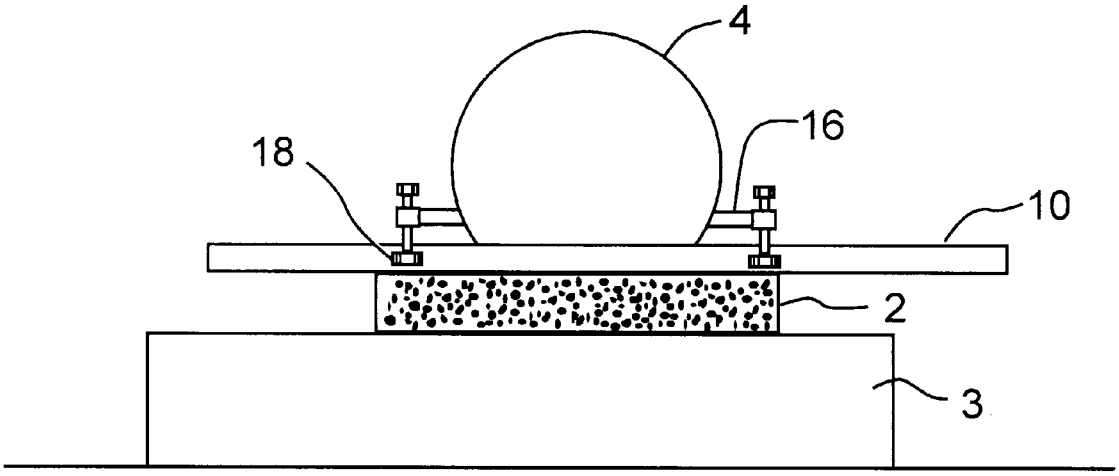
FIG. 4 is a side elevational view of the apparatus of FIG. 3.

FIGS. 1 and 2 should now be compared with FIGS. 3 and 4, respectively, which show the cutting apparatus in accordance with the present invention. In accordance with the present invention the rails 10 rest directly on the upper surface 12 of the slab 2. The slab 2 is supported at a convenient height by a table or stand 3. Note that the rails 10 cannot deform because they are supported by the slab along most of their length. Accordingly, there is no need for the supports 9 of FIGS. 1 and 2 for the rails.

The weight of the carriage 16 is transferred to the rails through glide posts 14 that are composed of a non-stick material. Because the guide posts have a small cross sectional area in contact with the rails, a more positive vibration-free contact is achieved and any contaminating chips that might be lying on the rails are pushed out of the way without causing the carriage to jolt. Laterally, the carriage is restrained to move along the rails 10 by guide wheels, of which the wheel 18 is typical.

It is not necessary for the weight of the carriage to be balanced equally between the two rails 10. Regardless of the weight of the carriage, the rails cannot sag because they are supported by the slab 2. A further advantage is that the heavier the carriage 16 is, the greater will be the force pushing the rails downward against the slab 2, thereby increasing the friction between the rails and the slab so as to prevent the rails from skidding on the slab.

In a preferred embodiment of the invention, the rails 10 are not connected to each other, or to anything else. As will be seen below, a special calibration instrument, shown in FIG. 6 is used to locate the rails at the required distances from the desired cut line. After the rails have thus been positioned, the carriage is laid upon the rails in the position shown in FIG. 3.

As shown in FIG. 5, in the preferred embodiment, each of the rails 10 has a hollow rectangular cross section. A thin sheet 20 of a soft rubber is bonded to the lower side 22 of each rail. The thin sheet 20 of resilient material serves several purposes. First, it has a high coefficient of friction, which increases the frictional force resisting skidding of the rails on the slab. Second, the sheet 20 prevents the rails from scratching the upper surface 12 of the slab. Third, if there are any small particles lying on the upper surface of the slab, they will tend to be pushed into the resilient sheet 20 so as not to cause tilting of the rail with respect to the upper surface of the slab.

Figure 7:
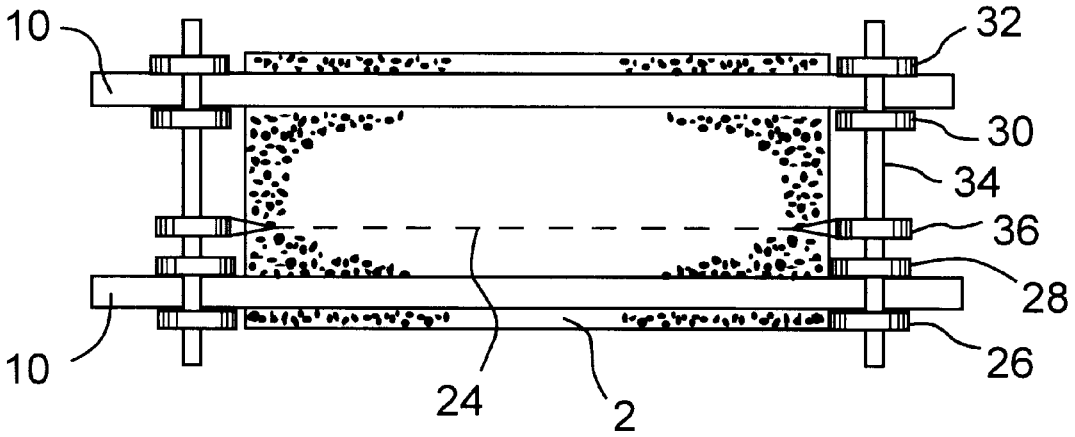
FIG. 7 is a top plan view showing how the calibration device of FIG. 6 is used with a preferred embodiment of the present invention; and, FIG. 8 is a top plan view showing the connected rails used in an alternative embodiment of the present invention.

FIG. 6 shows a calibration instrument that is used for positioning the rails 10, shown in dashed lines in FIG. 6, with respect to the desired cut line 24 which ordinarily is marked on the slab with a pencil. FIG. 7 is a top view showing the calibration instrument in use.

Initially, the rails 10 are laid on the slab 2 on opposite sides of the desired cut line 24 in approximately the desired positions as determined by the user based on his experience. Next, the calibration instrument is laid across the rails in the position shown in FIG. 6 and one rail is inserted into the space between the stops 26 and 28, and the other rail is inserted between the stops 30 and 32. The stops 26 and 28 are separated sufficiently that the rail 10 slides into position between them in a loose sliding fit. Likewise, the stops 30 and 32 are separated sufficiently that the other rail fits into the space between them in a loose sliding fit. The space between the stop 28 and the stop 30 is determined by the width of the carriage. The lateral location of the pointer 36 with the respect to the stops 28 and 30 corresponds to the lateral position of the cutting blade 4 with respect to the guide wheels 18 of the carriage. The stops 26, 28, 30 and 32 are not moved with respect to the lateral member 34 during the calibration process.

The user is provided with two calibration instruments of the type shown in FIG. 6. These are spaced along the desired cut line 24 as shown in FIG. 7. The user simultaneously moves both calibration instruments (along with the rails) until the pointers of both instruments lie on the desired cut line.

Thus, the calibration instrument provides a convenient way of rendering the rails parallel, of achieving the proper spacing between the rails, and of positioning the rails with respect to the desired cut line.

Although in theory the rails could be properly positioned with respect to the desired cut line if the stops 26 and 32 were not present, it is found convenient to include those stops so that the rails will be constrained to move together when the lateral adjustments are made.

In the preferred embodiment, neither of the rails 10 is connected to anything else. If the rails were connected to each other, they would have to be moved as a unit weighing more than twice as much as each individual rail. Therefore, portability is enhanced by at least a factor of two by not interconnecting the rails.

Figure 8:
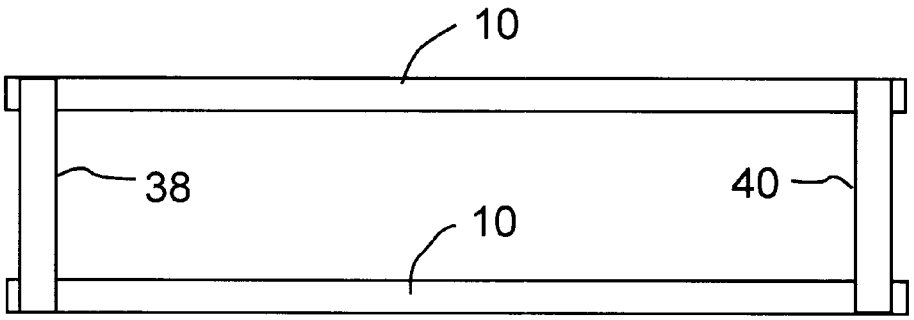

However, in some situations, portability is not an important consideration. For example, if the rails are relatively short, their combined weight may still be quite manageable. Also, in some instances, transporting of the cutting apparatus may not be contemplated. In such cases where portability is not important, it is still within the scope of the present invention to join the rails 10 in juxtaposition by the rigid laterally extending members 38 and 40, as shown in FIG. 8.

Thus, there has been described an apparatus and a method for producing accurate straight cuts in a slab of stone, concrete, or the like. In accordance with the present invention, a carriage conveys the cutter along two parallel rails that lie directly upon the upper surface of the slab to be cut. In a preferred embodiment of the invention, neither rail is connected to anything else, and a sheet of resilient material is bonded to the underside of each rail. A calibration instrument has been described, which is used to facilitate spacing the rails specific distances on either side of the desired cut line. Because the rails can be moved one at a time in the preferred embodiment, the apparatus is highly portable. In an alternative embodiment in which portability is not an important consideration, the rails may be permanently joined by rigid lateral members.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. Apparatus for producing a straight cut along a desired cut line in a substantially horizontal slab of stone or concrete, comprising:

a pair of hollow rails resting on the slab in direct contact with the slab, said rails being parallel to each other and spaced specific distances from, and on opposite sides of the desired cut line, each of said pair of rails having a lower surface including a sheet of resilient material bonded to the lower surface thereby resisting skidding of the rail on the slab;

a carriage adapted to slide along said pair of rails; and a rotary cutting blade mounted on said carriage to produce the straight cut along the desired cut line while being guided by said pair of rails.

2. The apparatus of claim 1 further comprising a lateral cross member interconnecting said pair of rails.

3. A method for using a carriage-mounted cutting blade to produce a straight cut in a substantially horizontal slab of stone or concrete having a substantially flat upper face, said method comprising the steps of:

a) marking on the upper face of the slab a line along which the cut is to be made;

b) laying a pair of hollow rails, each having a cross section including a flat lower side which has a sheet of resilient material adjacent thereto, on the upper face of the slab in direct contact with the upper face of the slab; and c) positioning the rails parallel to the marked line and spacing them specific distances from the line on opposite sides of the line, so that the cutting blade will follow the line when the carriage is moved along the rails.

4. Apparatus for producing a straight cut along desired cut line in a substantially horizontal slab of stone or concrete, comprising:

a pair of hollow rails each having a cross section including a flat lower side resting on the slab in direct contact with the slab, said rails being parallel to each other and spaced specific distances from, and on opposite sides of the desired cut line, each of said pair of rails having a flat lower surface including a sheet of resilient material bonded to the lower surface thereby resisting skidding of the rail on the slab;

a carriage adapted to slide along an upper portion of said pair of rails; and a rotary cutting blade mounted on said carriage to produce the straight cut along the desired cut line while being guided by said pair of rails.

* * * * *